US009631571B2

(12) United States Patent
Kiani et al.

(10) Patent No.: US 9,631,571 B2
(45) Date of Patent: Apr. 25, 2017

(54) FUEL ANTI-FREEZE SYSTEM

(71) Applicants: Mohammad Kiani, Izeh (IR); Abbas Saeidi Asl, Izeh (IR)

(72) Inventors: Mohammad Kiani, Izeh (IR); Abbas Saeidi Asl, Izeh (IR)

( * ) Notice: Subject to any disclaimer, the term of this patent is extended or adjusted under 35 U.S.C. 154(b) by 62 days.

(21) Appl. No.: 14/629,488

(22) Filed: Feb. 24, 2015

(65) Prior Publication Data

US 2016/0245219 A1 Aug. 25, 2016

(51) Int. Cl.

| | |
|---|---|
| ***F02D 41/30*** | (2006.01) |
| ***F02M 63/02*** | (2006.01) |
| ***F02D 33/00*** | (2006.01) |
| *F02D 41/04* | (2006.01) |

(52) U.S. Cl.

CPC ..... *F02D 41/3082* (2013.01); *F02D 33/006* (2013.01); *F02M 63/0245* (2013.01); *F02D 41/042* (2013.01); *F02D 2200/0606* (2013.01)

(58) Field of Classification Search

CPC ..... F02D 35/02; F02D 41/30; F02D 41/3005; F02D 41/3082; F02D 41/38; F02D 41/3836; F02M 59/46; F02M 59/466

USPC ..... 123/445, 446, 458, 464, 465, 480, 481, 123/495; 701/102–104, 112, 113

See application file for complete search history.

(56) References Cited

U.S. PATENT DOCUMENTS

| | | | | |
|---|---|---|---|---|
| 8,833,341 | B2 * | 9/2014 | Wong | F02D 17/02 123/41.2 |
| 2010/0012102 | A1 * | 1/2010 | Webb | F02M 37/0064 123/552 |
| 2011/0202256 | A1 * | 8/2011 | Sauve | F02D 41/0025 701/104 |
| 2013/0000279 | A1 * | 1/2013 | Muramatsu | F01N 3/025 60/274 |
| 2014/0245995 | A1 * | 9/2014 | Deliyski | F02M 69/50 123/456 |

* cited by examiner

*Primary Examiner* — Johnny H Hoang
(74) *Attorney, Agent, or Firm* — Barry Choobin; Patent 360

(57) ABSTRACT

The embodiments herein provide a fuel anti-freeze system comprising a temperature sensor, an Engine Control Unit (ECU), a combustion rail pump and two electrical valves. The temperature sensor reports an atmospheric temperature of a fuel rail to the ECU. The ECU controls the combustion rail pump and the electrical valves to control a depletion of the fuel from the fuel rail to a fuel tank, when the atmosphere temperature in the fuel rail is below a threshold temperature. The system empties the fuel rail when the atmosphere temperature is below the threshold temperature, thereby preventing freezing and stiffing of the fuel in the fuel rail of an internal combustion engine. The first electrical valve transfers the fuel from the fuel rail to the fuel tank, and the second electrical valve transfers the fuel from the fuel rail to the fuel tank.

7 Claims, 2 Drawing Sheets

FUEL ANTI-FREEZE SYSTEM

SPONSORSHIP STATEMENT

The present invention is sponsored by INSF (Iranian National Science Foundation) for international filing

BACKGROUND

Technical Field

The embodiments herein are generally related to an internal combustion engine. The embodiments herein are particularly related to a gas-oil system in internal combustion engines. The embodiments herein are more particularly related to a system and method for preventing freezing of a fuel in the internal combustion engine. The embodiments herein provide a gas-oil antifreeze system for preventing a cooling of gas-oil in rail in the internal combustion engines.

Description of the Related Art

An internal combustion engine for a motor vehicle generally comprises an engine block that defines at least one cylinder accommodating a reciprocating piston coupled to rotate a crankshaft. The cylinder is closed by a cylinder head that cooperates with the reciprocating piston to define a combustion chamber. A fuel and air mixture is cyclically disposed in the combustion chamber and ignited, thereby generating hot expanding exhaust gasses that cause the reciprocating movements of the piston. The fuel is injected into each cylinder by a respective fuel injector. The fuel is provided at high pressure to each fuel injector from a fuel rail in fluid communication with a high pressure fuel pump that increases the pressure of the fuel received from a fuel source.

The internal combustion engines comprise a cooling system for thermal management. In the past, the vehicle are installed with the manual heaters to melt the frozen fuel. Since the manual heaters are very perilous, the manual heaters are replaced by the electrical heaters which are located in the fuel tank, close to the fuel rail. With drawbacks in the electrical heaters, a process and technique for detachment of water and fuel is introduced. The technique has partly reduced the cooling temperature as well as the efficiency. As an enhancement to the aforementioned technique, the tank temperature is enhanced up to −80° C. by adding the alcohol to the water and fuel mixture. The fuel is a material with −80° C. cooling temperature and 5° C. solidity. Meantime, the water volume was raised at the temperature below 4° C. This issue led to some deficiency of relevant portions of the internal combustion engine, such as fuel rail. The deficiency was caused due to high pressure movement of particles in the trail rail. The supplementary portions of the internal combustion engine namely heater system, battery and the like portions, raise the final cost.

In the view of foregoing, there is a need for a low cost and efficient antifreeze system and method for preventing a freezing of the fuel in the fuel rail of the internal combustion engine.

The above mentioned shortcomings, disadvantages and problems are addressed herein and which will be understood by reading and studying the following specification.

OBJECTS OF THE EMBODIMENTS HEREIN

The primary object of the embodiments herein is to provide an anti-freeze system and method for preventing stiffing of a fuel in a fuel rail of an internal combustion engine.

Another object of the embodiments herein is to eliminate use of a fuel stoker in the internal combustion engine of the vehicle.

Yet another object of the embodiment herein is to develop a low cost anti-freeze system which reduces the system mounting/installation and operating costs.

Yet another object of the embodiments herein is to increase a battery life of the internal combustion engine by eliminating use of fuel heaters in the internal combustion engine.

Yet another object of the embodiments herein is to optimize the maintenance costs of the ant-freeze system in the internal combustion engine.

These and other objects and advantages of the embodiments herein will become readily apparent from the following summary and the detailed description taken in conjunction with the accompanying drawings.

SUMMARY

The various embodiments herein provide a fuel anti-freeze system for an internal combustion engine of a vehicle. The fuel anti-freeze system comprises a temperature sensor, an Engine Control Unit (ECU), a combustion rail pump and at least two electrical valves. The temperature sensor is configured to measure an atmosphere temperature in a fuel rail. The Engine Control Unit (ECU) is configured to control a depletion of the fuel from the fuel rail to a fuel tank, only in an event when the atmosphere temperature in the fuel rail is below a threshold temperature. The combustion rail pump is controlled by the ECU. The combustion rail pump is configured to vacuumize and deplete the fuel in the fuel rail. The electrical valves are configured to provide a means for transferring the fuel from the fuel rail to the fuel tank. The system comprises a first electrical valve which in combination with the combustion rail pump provides a first mode of operation for transferring the fuel from the fuel rail to the fuel tank. Furthermore a second electrical valve in combination with the first electrical valve provides a second mode of operation for transferring the fuel from the fuel rail to the fuel tank.

According to an embodiment herein, the temperature sensor measures the atmosphere temperature of the fuel rail only when the internal combustion engine of the vehicle is turned off.

According to an embodiment herein, the temperature sensor periodically measures and reports the atmospheric temperature of the fuel rail to the ECU.

According to an embodiment herein, the combustion rail pump is operated by the ECU to provide a suction for evacuating the fuel from the fuel rail to the fuel tank through the first electrical valve.

According to an embodiment herein, the first electrical valve is typically in a closed position. The first electrical valve is opened by the ECU to allow a flow of vacuumed fuel from the fuel rail to the fuel tank.

According to an embodiment herein, the second electrical valve is connected to a high pressure air storage. The high pressure air storage is filled with air stored at high pressure.

According to an embodiment herein, the second electrical valve receives a command from the ECU for injecting high pressure air into the fuel rail. A force produced by the high pressure air depletes the fuel from the fuel rail and the first electrical valve is opened by the ECU to transfer the fuel to the fuel tank.

The embodiments herein provide a method for preventing a freezing of a fuel in an integral combustion engine of a vehicle. The method comprising steps of measuring the atmosphere temperature of the fuel rail in the internal combustion engine of the vehicle, determining/judging/detecting the atmosphere temperature of the fuel rail to be below the threshold temperature and controlling the depletion of the fuel from the fuel rail to the fuel tank. The Engine Control Unit (ECU) operates the electrical valves only in the event that the atmosphere temperature of the fuel rail is below the threshold temperature.

According to an embodiment herein, the step of controlling the depletion of the fuel from the fuel rail to the fuel tank further comprises steps of providing a suction by a combustion rail pump for evacuating the fuel from the fuel rail, and transferring the fuel to the fuel tank by opening a first electrical valve.

According to an embodiment herein, the step of controlling a depletion of the fuel from the fuel rail to the fuel tank further comprises steps of opening a second electrical valve on receiving a command from the ECU, injecting high pressure air from a high pressure air storage into the fuel rail for forcing out the fuel from the fuel rail and transferring the fuel to the fuel tank by opening the first electrical valve.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
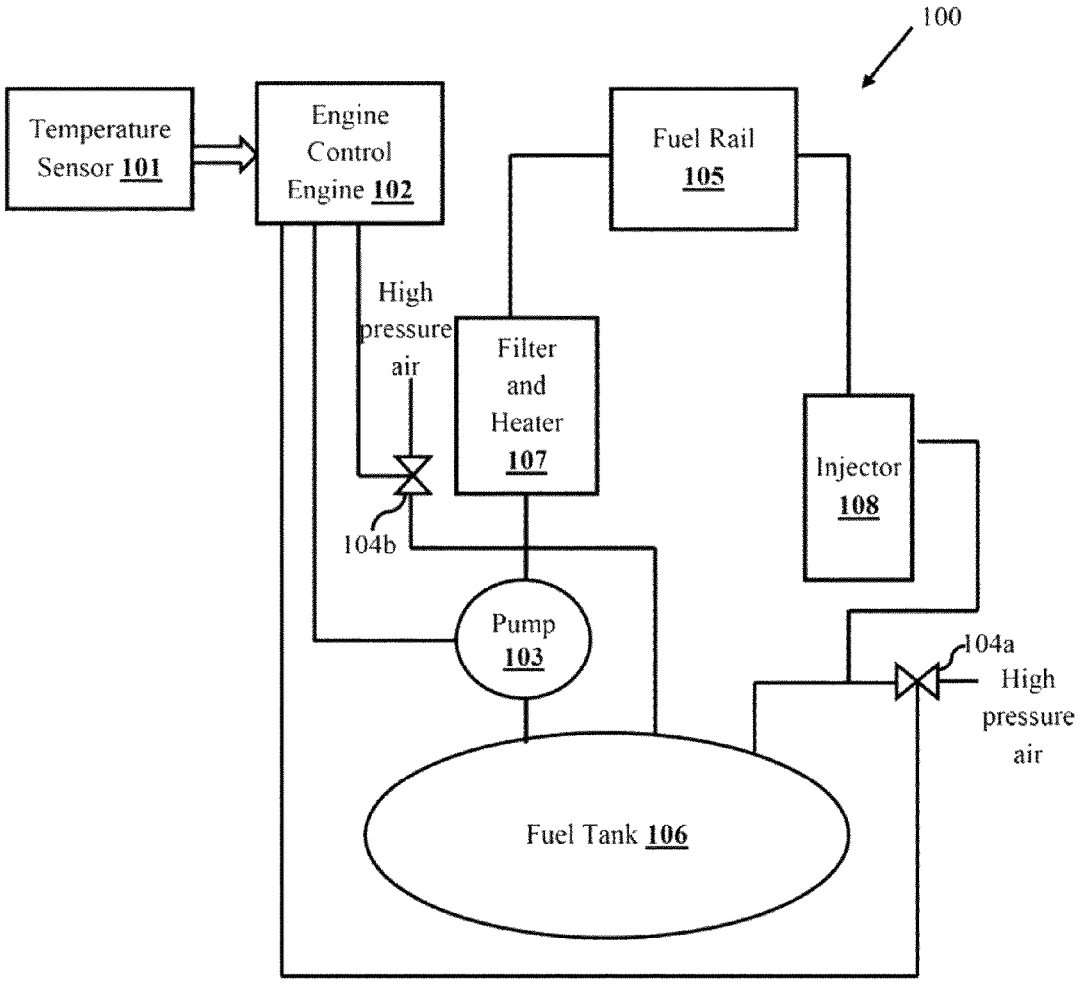
FIG. 1 illustrates a block circuit diagram of a fuel anti-freeze system integrated in an internal combustion engine, according to an embodiment herein.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE EMBODIMENTS HEREIN

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a fuel anti-freeze system for an internal combustion engine of a vehicle. The fuel anti-freeze system comprises a temperature sensor, an Engine Control Unit (ECU), a combustion rail pump and at least two electrical valves. The temperature sensor is configured to measure an atmosphere temperature in a fuel rail. The Engine Control Unit (ECU) is configured to control a depletion of the fuel from the fuel rail to a fuel tank, only in an event when the atmosphere temperature in the fuel rail is below a threshold temperature. The combustion rail pump is controlled by the ECU. The combustion rail pump is configured to vacuumize and deplete the fuel in the fuel rail. The electrical valves are configured to provide a means for transferring the fuel from the fuel rail to the fuel tank. The system comprises a first electrical valve which in combination with the combustion rail pump provides a first mode of operation for transferring the fuel from the fuel rail to the fuel tank. Furthermore a second electrical valve in combination with the first electrical valve provides a second mode of operation for transferring the fuel from the fuel rail to the fuel tank.

According to an embodiment herein, the temperature sensor measures the atmosphere temperature of the fuel rail only when the internal combustion engine of the vehicle is turned off.

According to an embodiment herein, the temperature sensor periodically measures and reports the atmospheric temperature of the fuel rail to the ECU.

According to an embodiment herein, the combustion rail pump is operated by the ECU to provide a suction for evacuating the fuel from the fuel rail to the fuel tank through the first electrical valve.

According to an embodiment herein, the first electrical valve is typically in a closed position. The first electrical valve is opened by the ECU to allow a flow of vacuumed fuel from the fuel rail to the fuel tank.

According to an embodiment herein, the second electrical valve is connected to a high pressure air storage. The high pressure air storage is filled with air stored at high pressure.

According to an embodiment herein, the second electrical valve receives a command from the ECU for injecting high pressure air into the fuel rail. A force produced by the high pressure air depletes the fuel from the fuel rail and the first electrical valve is opened by the ECU to transfer the fuel to the fuel tank.

The embodiments herein provide a method for preventing a freezing of a fuel in an integral combustion engine of a vehicle. The method comprising steps of measuring the atmosphere temperature of the fuel rail in the internal combustion engine of the vehicle, determining/judging/detecting the atmosphere temperature of the fuel rail to be below the threshold temperature and controlling the depletion of the fuel from the fuel rail to the fuel tank. The Engine Control Unit (ECU) operates the electrical valves only in the event that the atmosphere temperature of the fuel rail is below the threshold temperature.

According to an embodiment herein, the step of controlling the depletion of the fuel from the fuel rail to the fuel tank further comprises steps of providing a suction by a combustion rail pump for evacuating the fuel from the fuel rail, and transferring the fuel to the fuel tank by opening a first electrical valve.

According to an embodiment herein, the step of controlling a depletion of the fuel from the fuel rail to the fuel tank further comprises steps of opening a second electrical valve on receiving a command from the ECU, injecting high pressure air from a high pressure air storage into the fuel rail for forcing out the fuel from the fuel rail and transferring the fuel to the fuel tank by opening the first electrical valve.

According to an embodiment herein, the system comprises an Electronic Control Unit (ECU), a temperature sensor, an intake pump and two electrical valves. The system and the valve are operated in two ways. At first, the automobile or the vehicle is turned off. The automobile must be turned off and atmospheric temperature is less than 5°, and the temperature of the system is less than predefined value.

According to an embodiment herein, the fuel rail is depleted, when the automobile is turned off and atmospheric temperature is less than 5°, or the temperature of the system is less than predefined value. Electrical valve is turned on accompanied by intake pump and gasoil is depleted from fuel rail and transferred to tank.

According to an embodiment herein, only electrical valve acts as a subsequence, when the fuel rail is depleted by injecting the wind from tank source. The temperature is reported by a sensor to ECU which is stored by a programmed memory until the fuel rail to be depleted via two ways. By means of a pump and electrical valve, the fuel rail is vacuumed and depleted thereby moving the gasoil to the tank.

According to an embodiment herein, the fuel rail is vacuumed and depleted thereby moving the gasoil to the tank, by injecting the air into the fuel rail using the electrical valve.

According to an embodiment herein, the fuel tank in the automobile is covered on the other hand by nano structure that preserves the gasoil up to −80°.

According to an embodiment herein, the system comprises an Electronic Control Unit (ECU), a temperature sensor, an intake pump and two electrical valves.

According to an embodiment herein, the temperature sensor is configured to: evaluate environment's temperature and also report the evaluated environment temperature to the ECU.

According to an embodiment herein, the ECU is a microcontroller which saves logical commands and sagaciously transfers the received information from the temperature sensor to the system in accordance with executive instruction.

According to an embodiment herein, the electrical pump is operated to vacuum and deplete the gasoil in fuel rail. The electrical pump is located on initial path of fuel rail and next to tank.

According to an embodiment herein, the first electrical valve is closed and opened by ECU and always is in closed status. In this situation/condition, the first electrical valve is run by electro pump and employed/aimed at substituting the air. Meantime, the first electrical valve is located at the end of return path of gasoil.

According to an embodiment herein, the second electrical valve is opened and closed by ECU and always is in closed status. In this station, the second electrical valve is connected to the high pressure air storage tank. The command is done by ECU, and also the fuel rail is depleted vial air's pressure.

According to an embodiment herein, the Gasoil filter purifies the rubbish in gasoil. The fuel heater has been used for smoothing of fuel, easy working and fast turning on the automobile.

According to an embodiment herein, the injector spatters the fuel by catching the command from ECU.

According to an embodiment herein, the fuel tank is configured for the gasoil storage of the automobile.

According to an embodiment herein, the injector pump is used for dividing the fuel and increasing the gasoil pressure that receives its force by auto's motor.

FIG. 1 illustrates a block circuit diagram of a fuel anti-freeze system integrated in an internal combustion engine, according to an embodiment herein. The fuel anti-freeze system 100 comprises a temperature sensor 101, an Engine Control Unit (ECU) 102, a combustion rail pump 103 and at least two electrical valves 104. The temperature sensor 101 is configured to measure an atmosphere temperature in a fuel rail 105. The temperature sensor 101 measures the atmosphere temperature of the fuel rail 105 only when the internal combustion engine of the vehicle is turned off. The temperature sensor 101 periodically reports the atmospheric temperature of the fuel rail 105 to the ECU 102. The Engine Control Unit (ECU) 102 is configured to control a depletion of the fuel from the fuel rail to a fuel tank, only in an event that the atmosphere temperature in the fuel rail is below a threshold temperature. The combustion rail pump 103 and the electrical valves 104 are controlled by the ECU 102. The system 100 empties the fuel rail 105 when the atmosphere temperature is below the threshold temperature, thus preventing freezing and stiffing of the fuel in the fuel rail 105 of the internal combustion engine.

The fuel depletion from the fuel rail 105 is executed using one of at least two modes of operation. A first electrical valve 104*a* which, in combination with the combustion rail pump 103 provides a first mode for transferring the fuel from the fuel rail 105 to a fuel tank 106. Furthermore a second electrical valve 104*b* in combination with the first electrical valve 104*a* provides a second mode for transferring the fuel from the fuel rail 105 to the fuel tank 106. The first electrical valve is configured to transfer the depleted fuel from the fuel rail 105 to the fuel tank 106. The first electrical valve 104*a* is typically in a closed position. The first electrical valve 104*a* is opened by the ECU 102 to allow a flow of the depleted fuel from the fuel rail 105 to the fuel tank 106.

In first mode of fuel depletion, the combustion rail pump 103 is operated by the ECU 102 to utilize a suction for evacuating the fuel from the fuel rail 105 to the fuel tank 106 through the first electrical valve. The first electrical valve 104*a* transfers the depleted fuel from the fuel rail 105 to the fuel tank 106.

The second electrical valve 104*b* is connected to a high pressure air storage. The high pressure air storage is filled with air stored at a high pressure. The second electrical valve 104*b* receives a command from the ECU 102 for injecting high pressure air into the fuel rail 105. A force produced by the high pressure air depletes the fuel from the fuel rail 105 and the first electrical valve 104*a* is opened by the ECU 102 to transfer the fuel to the fuel tank 106.

The system 100 comprises a filter 107 which purifies a waste from the fuel from the fuel rail 105. The system 100 further comprises a fuel heater 107 configured to smoothen the fuel for easy ignition of fuel and efficient working of the internal combustion. The system 100 furthermore comprises an injector 108 configured to spray the fuel from the fuel rail 105 into the engine, when a command is received from the ECU 102.

Figure 2:
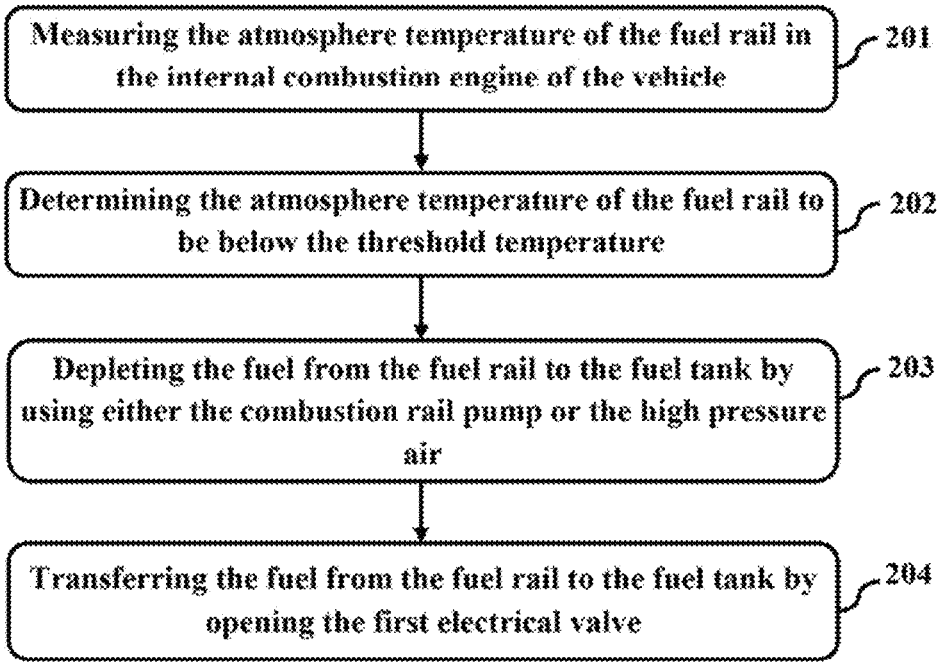
FIG. 2 illustrates a flowchart indicating a method for preventing a freezing of a fuel in the integral combustion engine of a vehicle, according to an embodiment herein.

FIG. 2 illustrates a flowchart explaining a method for preventing a freezing of a fuel in the integral combustion engine of a vehicle, according to an embodiment herein. The method comprises the steps of measuring the atmosphere temperature of the fuel rail in the internal combustion engine of the vehicle (Step 201). The temperature sensor is activated, only when the internal combustion engine of the vehicle is turned off. The temperature sensor measures the atmosphere temperature and periodically transmits the measured temperature data to the ECU. This step is followed by a Step 202 of determining the atmosphere temperature of the fuel rail to be below the threshold temperature. In the event that the atmosphere temperature of the fuel rail is below the threshold temperature, the Engine Control Unit (ECU) operates the electrical valves to open. At Step 203, the step of controlling the depletion of the fuel from the fuel rail is performed. The fuel depletion is executed in one of at least two modes. In the first mode, a suction is provided by the combustion rail pump for evacuating the fuel from the fuel rail. In the second mode, the high pressure air from a high pressure air storage is injected into the fuel rail for forcing out the fuel from the fuel rail. The outlet of the high pressure air storage is controlled by the second valve. The ECU commands the second valve to open condition so as to supply the high pressure air to the fuel rail. The force created by the high pressure air enables the fuel to deplete from the fuel rail. The Step 203 is followed by Step 204 of transferring the fuel from the fuel rail to the fuel tank by opening the first electrical valve.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A fuel anti-freeze system for an internal combustion engine of a vehicle, the fuel anti-freeze system comprising:

a temperature sensor configured to measure an atmosphere temperature and a temperature of fuel rail, and wherein the temperature sensor measures the atmosphere temperature and temperature of the fuel rail, only when the internal combustion engine of the vehicle is turned off;

an Electronic Control Unit (ECU) configured to control a depletion of a fuel from the fuel rail to a fuel tank, only in an event that the atmosphere temperature and the temperature in the fuel rail is below a threshold temperature;

a combustion rail pump controlled by the ECU, wherein the combustion rail pump is configured to vacuum and deplete the fuel in the fuel rail; and at least two electrical valves configured to transfer the fuel from the fuel rail to the fuel tank, and wherein the two electrical valves comprise a first electrical valve and a second electrical valve, and wherein the first electrical valve in combination with the combustion rail pump provides a first mode for transferring the fuel from the fuel rail to the fuel tank, and wherein the second electrical valve in combination with the first electrical valve provides a second mode for transferring the fuel from the fuel rail to the fuel tank, and wherein the second electrical valve receives a command from the ECU for injecting a high pressure air into the fuel rail, and wherein a force produced by the high pressure air depletes the fuel from the fuel rail and the first electrical valve is opened by the ECU to transfer the fuel to the fuel tank.

2. The system according to claim 1, wherein the temperature sensor periodically reports the atmospheric temperature of the fuel rail to the ECU.

3. The system according to claim 1, wherein the combustion rail pump is operated by the ECU to provide a suction for evacuating the fuel from the fuel rail to the fuel tank through the first electrical valve.

4. The system according to claim 1, wherein the first electrical valve is typically in a closed position, and wherein the first electrical valve is opened by the ECU to allow a flow of vacuumed fuel from the fuel rail to the fuel tank.

5. The system according to claim 1, wherein the second electrical valve is connected to a high pressure air storage, and wherein the high pressure air storage is filled with air stored at high pressure.

6. A method for preventing freezing of a fuel in an internal combustion engine of a vehicle, the method comprising steps of:

measuring an atmosphere temperature and a temperature of a fuel rail in the internal combustion engine of the vehicle by using a temperature sensor;

determining the atmosphere temperature and the temperature of the fuel rail to be below a threshold temperature by an electronic control unit; and controlling a depletion of the fuel from the fuel rail to a fuel tank, by the Electronic Control Unit (ECU), only in an event that the atmosphere temperature and the temperature of the fuel rail is below the threshold temperature, wherein the step of controlling the depletion of the fuel from the fuel rail to the fuel tank comprises providing a suction by a combustion rail pump for evacuating the fuel from the fuel rail and transferring the fuel to the fuel tank, wherein at least two electrical valves configured to transfer the fuel from the fuel rail to the fuel tank, and wherein the two electrical valves comprise a first electrical valve and a second electrical valve, and wherein the first electrical valve in combination with the combustion rail pump provides a first mode for transferring the fuel from the fuel rail to the fuel tank, and wherein the second electrical valve in combination with the first electrical valve provides a second mode for transferring the fuel from the fuel rail to the fuel tank.

7. The method according to claim 6, wherein the step of controlling a depletion of the fuel from the fuel rail to the fuel tank further comprises steps of:

opening a second electrical valve on receiving a command from the ECU;

injecting a high pressure air from a high pressure air storage into the fuel rail for forcing out the fuel from the fuel rail by using a second electrical valve; and transferring the fuel to the fuel tank, by opening the first electrical valve.

* * * * *